US008661843B2

(12) United States Patent
Klopp et al.

(10) Patent No.: US 8,661,843 B2
(45) Date of Patent: Mar. 4, 2014

(54) ICE PUSHER

(75) Inventors: Jerome C. Klopp, Arlington Heights, IL (US); James E. Pearson, Downers Grove, IL (US); Jermaine Ealy, Aurora, IL (US)

(73) Assignee: Robertshaw Controls Company, Carol Stream, IL (US)

( * ) Notice: Subject to any disclaimer, the term of this patent is extended or adjusted under 35 U.S.C. 154(b) by 524 days.

(21) Appl. No.: 12/973,545

(22) Filed: Dec. 20, 2010

(65) Prior Publication Data

US 2012/0151956 A1 Jun. 21, 2012

(51) Int. Cl.
*F25D 3/02* (2006.01)

(52) U.S. Cl.
USPC ..... 62/376; 62/135; 74/55; 74/56

(58) Field of Classification Search
USPC ..... 62/135, 347, 67, 74; 74/55, 56, 89, 567; 403/343, 409.1, 59; 251/77
See application file for complete search history.

(56) References Cited

U.S. PATENT DOCUMENTS

| | | | | | |
|---|---|---|---|---|---|
| 2,389,317 | A | * | 11/1945 | Kitto | 62/73 |
| 2,946,202 | A | * | 7/1960 | Boeing | 62/135 |
| 2,990,692 | A | * | 7/1961 | Hubacker et al. | 62/71 |
| 3,306,072 | A | * | 2/1967 | Dahlgren et al. | 62/351 |
| 4,341,087 | A | | 7/1982 | Van Steenburgh, Jr. | |
| 4,489,567 | A | * | 12/1984 | Kohl | 62/138 |
| 4,662,183 | A | | 5/1987 | Keller | |
| 4,706,466 | A | * | 11/1987 | Yingst et al. | 62/138 |
| 4,732,006 | A | | 3/1988 | Fischer | |
| 4,769,430 | A | * | 9/1988 | Naitoh | 526/256 |
| 5,090,210 | A | * | 2/1992 | Katayanagi et al. | 62/135 |
| 5,617,728 | A | * | 4/1997 | Kim et al. | 62/71 |

* cited by examiner

*Primary Examiner* — Cheryl J Tyler
*Assistant Examiner* — David Teitelbaum
(74) *Attorney, Agent, or Firm* — Reinhart Boerner Van Deuren P.C.

(57) ABSTRACT

An ice pusher is provided. The ice pusher incorporates a cam and a linear actuation arrangement for removing ice from an evaporator plate of an ice-making machine. The cam provides a helix shaped ramp structure having a cam surface. The linear actuation arrangement has an input end and an output end. The input end is in slidable contact with the cam surface such that the linear actuation arrangement linearly moves relative to the housing upon rotation of the cam to effectuate the removal of ice from the evaporator plate.

8 Claims, 8 Drawing Sheets

ICE PUSHER

FIELD OF THE INVENTION

This invention generally relates to ice making machines, and more particularly to mechanisms for harvesting ice made in ice making machines.

BACKGROUND OF THE INVENTION

Conventional ice making machines are typically employed in commercial settings such as restaurants to make and store large quantities of ice. A typical ice making machine incorporates an ice making module and a containment module. The ice making module typically includes a refrigeration system, an evaporator plate in contact or in proximity to the expansion coils of the refrigeration system, and a water supply positioned to introduce a flow of water over the evaporator plate.

The evaporator plate is typically in a vertical orientation and positioned relative to the expansion coils such that the evaporator plate can be maintained at a below-freezing temperature. The water supply introduces the flow of water over the evaporation plate such that the water flows from a top end of the vertically mounted evaporator plate to a bottom end thereof under gravity. As the water flows over the evaporator plate, it undergoes a state change from liquid to solid to form a sheet of ice of a generally uniform thickness. The evaporator plate can be a simple plate, or include additional features such as grid work to facilitate the formation of a sheet of preformed connected ice cubes.

Once the sheet of ice is fully formed, it is removed from the plate and deposited into a containment bin of the containment module, and the ice-making cycle repeats. Users can access the containment bin and remove ice therefrom. Typically, the bin is positioned below the ice making module described above. The sheet of ice is removed from the plate such that it falls under gravity into the bin. Upon landing in the bin, the sheet of ice is broken into more manageable pieces. In the event that the sheet comprises connected ice cubes, the sheet typically fractures into the individual cubes, or smaller sheets of connected cubes.

The sheet of ice is typically removed from the evaporator plate by bypassing the heat exchanger coils of the refrigeration system, and sending compressed hot refrigerant gas directly through the expansion coils in proximity to the evaporator plate. This operation causes the temperature of the evaporator plate to rise, allowing the sheet of ice to break free from the evaporator plate, and fall into the bin as described above.

Unfortunately, in some instances, the temperature rise of the evaporator plate is not enough to break the sheet of ice free. Such a failure mode can arise when the ambient temperature surrounding the ice making machine is low and/or below freezing. Such a failure mode can also arise when the refrigerant has undergone a large number of cycles, thereby affecting its ability to transfer heat efficiently. The above failure mode can lead to an undesirable accumulation of ice upon the evaporator plate, or worse, overall failure of the ice maker.

As a result, devices have been introduced to ensure that the ice is completely removed from the evaporator plate with each ice-making cycle. One such device is the ice pusher. The ice pusher typically incorporates a linear actuation mechanism having a pushrod. The push rod is situated to pass through an aperture of the evaporator plate, and contact the sheet of ice to force it free from the evaporator plate.

As the evaporator plate heat cycle progresses, the linear actuation mechanism forces the pushrod through the aperture and against the ice to free it as described above. Contemporary ice pusher mechanisms can be designed as a fail-safe device, wherein the same is only employed when the evaporator plate heat cycle fails to free the ice from the evaporator plate, or these mechanisms can be designed to assist each cycle of ice removal so as to decrease the energy demand of the evaporator plate heat cycle.

Unfortunately, the contemporary ice pusher assembly typically incorporates a linear actuation mechanism in the form of a solenoid having a large coil and pushrod assembly. These components are relatively high weight components, and the overall mechanism has a relatively high energy demand. As the appliance industry continues to move in the trend of low weight, low energy consumption, high efficiency appliances, improvements are needed in the design of ice pusher devices to meet this trend. More specifically, there is a need in the art for a low weight, low energy consumption, compact ice pusher.

The invention provides such an ice pusher. These and other advantages of the invention, as well as additional inventive features, will be apparent from the description of the invention provided herein.

BRIEF SUMMARY OF THE INVENTION

In view of the above, embodiments of the present invention provide an ice pusher that overcomes existing problems in the art. More particularly, embodiments of the present invention provide a new and improved ice pusher mechanism that incorporates a cam and a linear actuation arrangement operable to bias a sheet of ice off of an evaporator plate. The incorporation of a cam and linear actuation arrangement results in a lighter, more compact, more efficient ice pusher than prior designs.

In one embodiment of the invention, an ice pusher for removing ice from an evaporator plate of an ice making machine is provided. The ice pusher includes a housing with a motor mounted to the housing. The motor has a rotatable drive shaft. A cam is also carried by the housing. The cam is coupled to the motor and rotatable relative to the housing with the drive shaft. A linear actuation arrangement is in contact with a cam surface of the cam such that the linear actuation arrangement moves linearly relative to the housing upon rotation of the cam.

In one embodiment, the linear actuation arrangement includes a coupling shaft slidably connected to a coupling body. The linear actuation arrangement further includes a biasing element interposed between the coupling shaft and the coupling body such that the biasing element biases the coupling shaft axially away from the coupling body.

In another embodiment, the coupling shaft extends between a first end and a second end. The first end abuts the cam surface of the cam. The second end is received in a coupling shaft aperture of the coupling body.

In another embodiment, the coupling shaft includes a coupling shaft flange positioned between the first and second ends of the coupling shaft. The coupling shaft flange provides an abutment surface. The biasing element of the linear actuation arrangement is in abutted contact with the abutment surface of the coupling shaft flange.

In another embodiment, the coupling body extends between a first end and a second end. The coupling shaft aperture is formed in the first end of the coupling body. A push rod aperture is formed in the second end of the coupling body and operable to receive a push rod assembly such that linear movement of the coupling body results in linear movement of the push rod assembly.

In another embodiment, the coupling body includes a coupling body flange positioned between the first and second ends of the coupling body. The coupling body flange provides first and second abutment surfaces in opposed spaced relation. The first abutment surface is in abutted contact with the biasing element of the linear actuation arrangement. The second abutment surface is in abutted contact with a bottom wall of the housing when the ice pusher is in an extended position.

In another embodiment, the coupling shaft, biasing element, and coupling body are moveable to a retracted position relative to the housing upon rotation of the cam in a first direction. The coupling shaft, biasing element, and the coupling body are also moveable to an extended position relative to the housing upon rotation of the cam in a second direction opposite the first direction.

In another embodiment, the coupling body extends from a bottom wall of the housing a first distance in the retracted position. The coupling body also extends from the bottom wall of the housing a second distance in the extended position. The second distance is greater than the first distance.

In another embodiment, the coupling shaft and biasing element are moveable relative to the housing and relative to the coupling body to a fail-safe position upon rotation of the cam in the second direction. The coupling body extends the first distance from the housing in the fail-safe position.

In another embodiment, the cam has a cylindrical inner core and a helix shaped ramp structure extending from the inner core. The helix shaped ramp structure provides the cam surface of the cam.

In another embodiment, the ice pusher further includes a sensor operably mounted to the housing to detect rotation of the cam.

In another embodiment, an ice pusher for removing ice from an evaporator plate of an ice making machine is provided. An ice pusher according to this embodiment includes a housing and a motor operably mounted to the housing. The motor has a drive shaft. A cam is coupled to the drive shaft and carried by the housing. The cam is rotatable relative to the housing with the drive shaft. The cam has a helix shaped ramp structure extending therefrom. The ramp structure provides a cam surface. The ice pusher also includes a linear actuation arrangement having an input end and an output end. The input end is in slidable abutted contact with the cam surface such that rotation of the cam in a first direction linearly displaces the output end of the linear actuation arrangement a first distance relative to the housing. Rotation of the cam in a second direction linearly displaces the output end of the linear actuation arrangement a second distance relative to the housing the second distance greater than the first distance.

In another embodiment, the housing includes a coupling shaft aperture and a coupling body aperture axially aligned with the coupling shaft aperture. The linear actuation arrangement extends through the coupling shaft aperture and the coupling body aperture. The input end of the linear actuation arrangement and cam surface are engaged such that rotation of the cam in the first direction increases a distance between the input end of the coupling shaft aperture and decreases a distance between the output end and the coupling body aperture.

In another embodiment, rotation of the cam in the second direction decreases the distance between the input end and the coupling shaft aperture and increases the distance between the output end and the coupling body aperture.

In another embodiment, the linear actuation arrangement includes a coupling shaft and a coupling body. The coupling shaft and coupling body are operably arranged to linearly move in unison upon rotation of the cam in the first direction and upon rotation of the cam in the second direction. The coupling shaft is operable to move relative to the coupling body upon rotation of the cam in the second direction.

In another embodiment, the ice pusher further includes a sensor mounted to the housing and operable to detect rotation of the cam in the first direction and rotation of the cam in the second direction. In another embodiment, the sensor is a switch type touch sensor. The sensor includes a rocker arm in contact with a cylindrical outer periphery of the cam. The sensor is operable to send a signal to a controller upon rotation of the cam in the first direction and rotation of the cam in the second direction.

In another embodiment, the motor is mounted to a top wall of the housing. The top wall defines an opening for receipt of the cam. The cam extends into the opening and is seated for rotation in a cam seating wall of the housing that is positioned below the top wall. In another embodiment, the motor is an AC synchronous motor.

In another embodiment, a method for removing a sheet of ice from an evaporator plate of an ice making machine is provided. A method according to this embodiment includes rotating a cam having a cam surface in a first direction to linearly extend a linear actuation arrangement having an input end in contact with the cam surface from a housing. The method also includes biasing at least a portion of the sheet of ice formed on the evaporator plate free from the evaporator plate with an output end of the linear actuation arrangement. In another embodiment, the method includes determining that a sufficient amount of ice has formed on the evaporator plate prior to rotating the cam in the first direction.

In another embodiment, the method includes determining that the step of biasing has removed the sheet of ice from the evaporator plate. The method also includes stopping the rotation of the cam in the first direction to stop the linear extension of the linear actuation arrangement from the housing.

In another embodiment, the method further includes rotating the cam in a second direction opposite the first direction to linearly retract the linear actuation arrangement into the housing after stopping rotating the cam in the first direction.

In another embodiment, the method further includes repeating the steps of determining that a sufficient amount of ice is formed on the evaporator plate and rotating the cam in the first direction after rotating the cam in the second direction.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
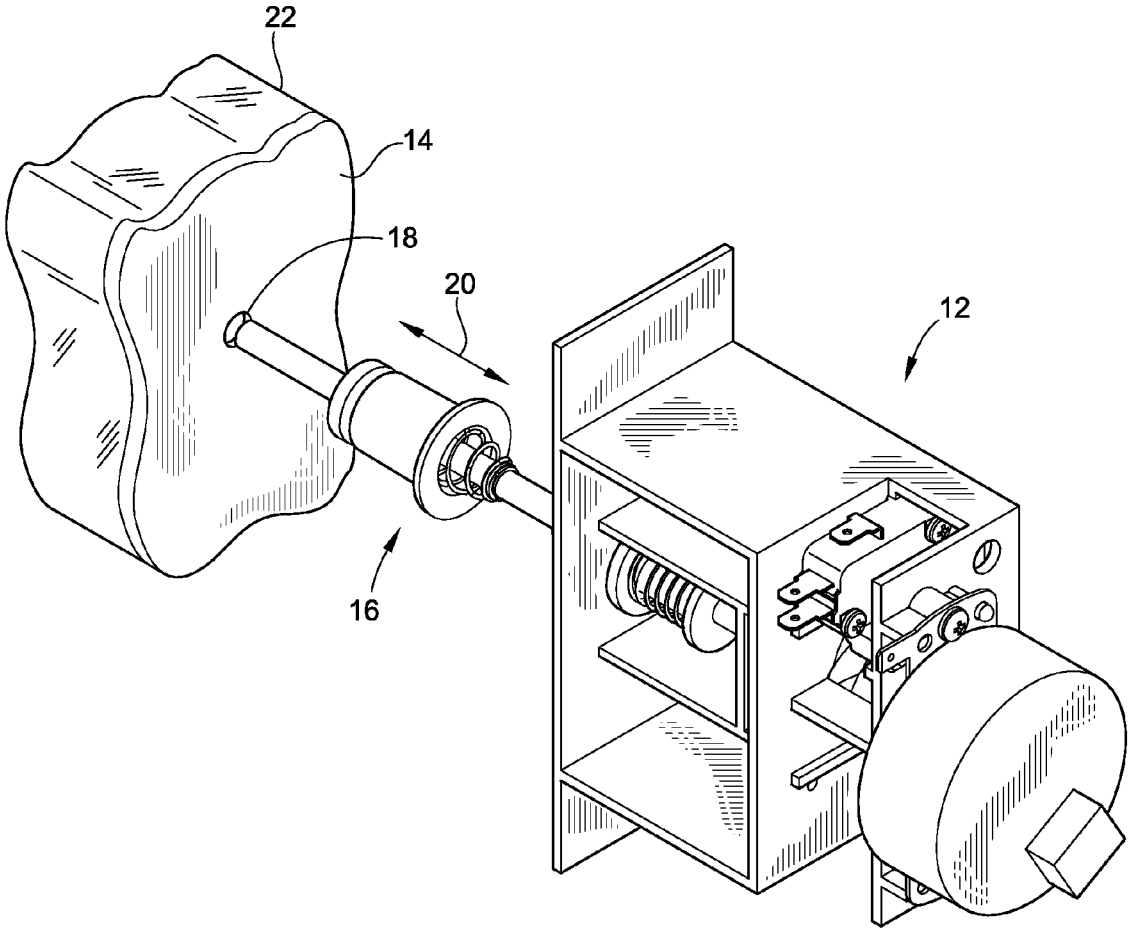
FIG. 1 is a perspective view of an embodiment of an ice pusher according to the teachings of the present invention, in proximity to an evaporator plate having a sheet of ice affixed thereto.

With reference now to the drawings, there is illustrated in FIG. 1 an exemplary embodiment of an ice pusher 12. The ice pusher 12 is situated in proximity to an evaporator plate 14, having a sheet of ice 22 formed thereon. As will be explained in greater detail below, the ice pusher 12 is configured to reciprocate a linear actuation arrangement including a pushrod assembly 16 along an axis parallel to axis 20 of FIG. 1 and through an aperture 18 formed in the evaporator plate to break the sheet of ice 22 therefrom. This reciprocation is made possible by a new and improved cam and linear actuation arrangement that omits the heavier, more inefficient solenoid systems of prior designs. While such an exemplary environment will be utilized in discussing the various aspects and advantages of the invention, it will be recognized that the ice pusher 12 may be equally employed in other ice-maker module environments, and is therefore not limited to that illustrated throughout the drawings, and described herein.

Further, the particular pushrod assembly 16 illustrated should also be taken by way of example and not by way of limitation. Indeed, the ice pusher 12, in certain embodiments, is supplied without a pushrod assembly 16, and can be configured to operate with a variety of existing pushrod assemblies. Therefore, the ice pusher 12 is not limited to the particular pushrod assembly 16 described herein, and the inclusion of the pushrod assembly 16 is not necessary in certain embodiments.

Figure 2:
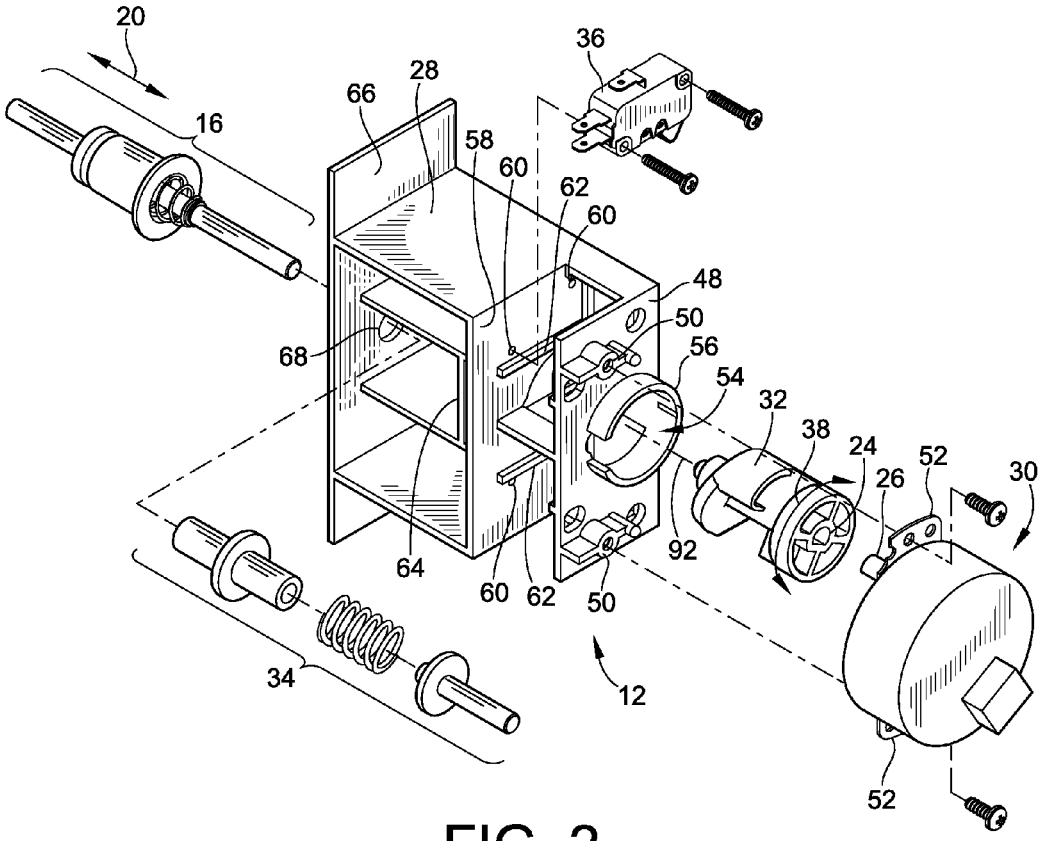
FIG. 2 is an exploded perspective view of the ice pusher and pushrod assembly of FIG. 1.

With particular reference now to FIG. 2, the ice pusher 12 includes a housing 28 carrying a motor 30. The motor 30 is operable to rotate a cam 32 along rotational direction 38 as illustrated. The cam 32 is operably connected to a coupling assembly 34 to cause linear movement of the linear actuation arrangement, and more specifically the pushrod assembly 16 and the coupling assembly 34, relative to the housing 28. The coupling assembly 34 is mechanically connected to the push rod assembly 16 such that the push rod assembly 16 moves with the linear movement of the coupling assembly 34 about an axis also parallel to axis 20.

As will be explained in greater detail in the following, the ice pusher 12 also includes a sensor 36 mounted to the housing 28. The sensor 36 is operable to detect the position of the cam 32, and send a signal to a controller to ultimately determine the position of the coupling assembly 34 and the push rod assembly 16. In the illustrated embodiment, the sensor 36 is a switch-type touch sensor. However, the sensor 36 can take a variety of forms, including but not limited to touch sensors, light sensors, rotation sensors, hall effect sensors, etc.

As illustrated in FIG. 2, the housing 28 is generally a box shaped structure. The motor 30 is positioned above a top wall 48 of the housing 28. A pair of motor mounting structures 50 extend from top wall 48 and receive a pair of motor mounting flanges 52 of the motor 30. The motor 30 includes an output shaft 26 received by an aperture 24 of the cam 32. The shaft 26 of the motor 30 and aperture 24 of the cam 32 are in a keyed relationship when assembled such that the cam 32 is not free to rotate relative to the shaft 26 of the motor. As such, any rotation of the shaft 26 is directly transferred to the cam 32 and results in rotation generally in rotational direction 38 as illustrated. The illustrated motor 30 is a synchronous electric motor. However, in other embodiments, other motors can be utilized such as AC induction motors, or DC motor types.

A sleeve 56 also extends from the top wall 48 of the housing 28. The sleeve 56 defines an opening 54 for receipt of the cam 32. The sleeve 56 is shaped such that the cam 32 is generally constrained to rotational movement within the housing 28 commensurate with the rotation of the shaft 26 of the motor 30 as described above.

An intermediate wall 58 is positioned below the top wall 48 of the housing 28. The intermediate wall 58 has a plurality of apertures 60 for the mounting of the sensor 36. The intermediate wall 58 also includes abutment structures 62 that further define the position of the sensor 36 when mounted. The apertures 60 and abutment structures 62 are arranged to allow for multiple mounting locations for the sensor 36.

The cam 32 passes through the upper wall 48 and intermediate wall 58 to seat against a cam seating wall 64 positioned below the intermediate wall 58. As will be explained in greater detail below, the cam seating wall 64 includes a cam shaft aperture 72 (see FIG. 5) for receipt of an end of the cam 32.

The housing 28 also includes a bottom wall 66 with a coupling body aperture 68 formed therein. The coupling assembly 34 is positioned within the housing 28 such that a portion thereof passes through a coupling shaft aperture 70 (see FIG. 5) formed in the cam seating wall 64 to contact the cam 32. The coupling assembly 34 also passes through the coupling aperture 68 formed in the bottom wall 66 of the housing 28. The push rod assembly 16 is received by the portion of the coupling assembly 34 extending below the bottom wall 66 through the coupling body aperture 68. The coupling body aperture 68 and coupling shaft aperture 70 are aligned to permit the linear movement of the coupling assembly 34 in response to rotation of the cam 32 as described below.

Figure 3:
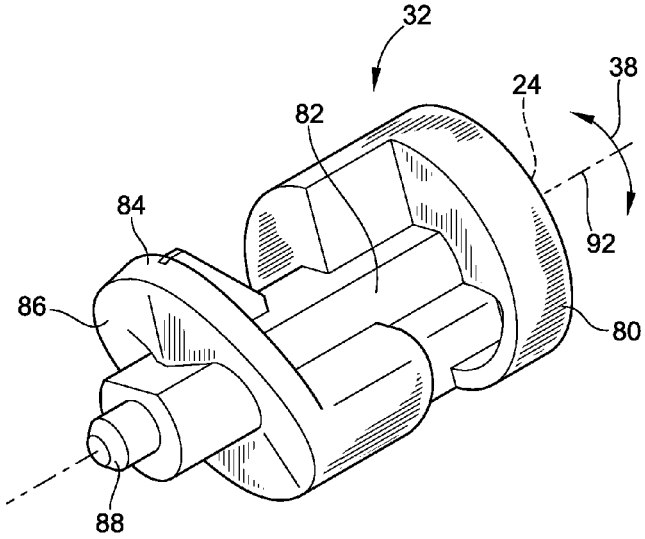
FIG. 3 is a perspective view of a cam of the ice pusher of FIG. 1.

Turning now to FIG. 3, the cam 32 is illustrated. The cam 32 has a generally cylindrical outer periphery 80 extending from a cylindrical inner core 82. A generally helix shaped ramp structure 84 also extends from the cylindrical inner core 82. The ramp structure 84 provides a cam surface 86 that interacts with the coupling assembly 34 (see FIG. 2) to transmit the rotational movements of the cam 32 about axis 92 into linear movement of the coupling assembly 34 as well as the push rod assembly 16 (see FIG. 2).

Figure 4:
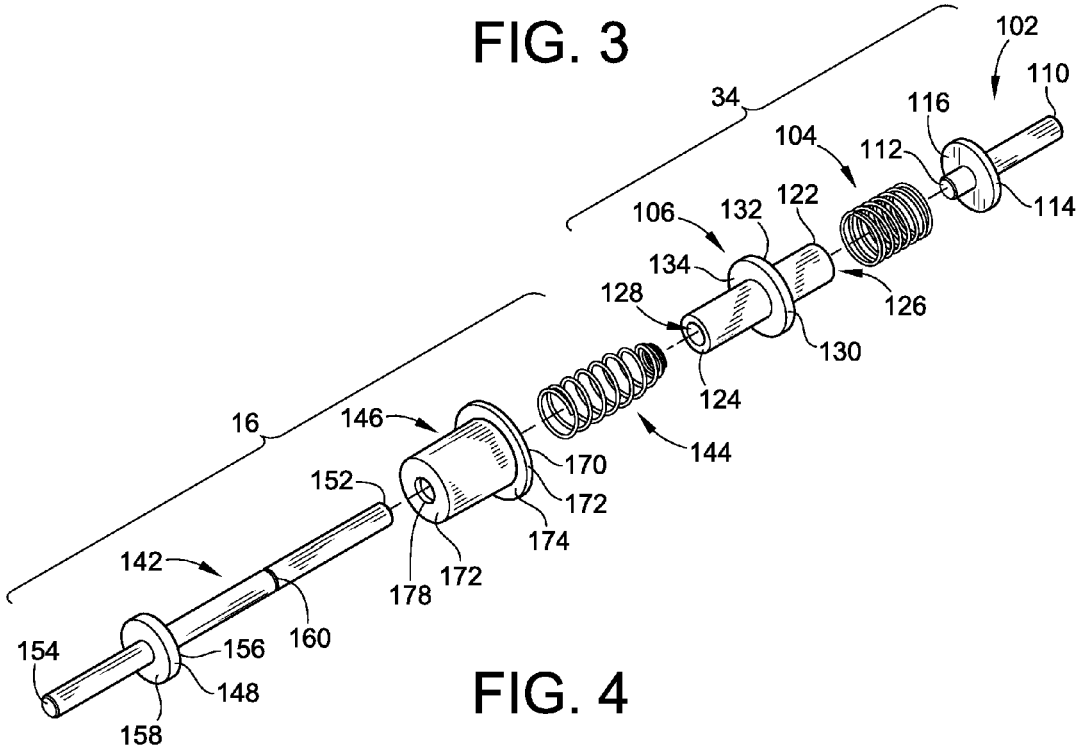
FIG. 4 is an exploded perspective view of a coupling assembly and a pushrod assembly of the ice pusher of FIG. 1.

Turning now to FIG. 4, an actuation arrangement of the ice pusher 12 including the coupling assembly 34 and pushrod assembly 16 is illustrated. The coupling assembly 34 and pushrod assembly 16 are generally axially aligned along a common center axis such that they form a generally rod-shaped assembly. The coupling assembly 34 includes a coupling shaft 102 slidably connected to a coupling body 106. A biasing element 104 is positioned between the coupling shaft 102 and coupling body 106. When the coupling assembly 34 is assembled, the biasing element 104 is operable to bias the coupling shaft 102 away from the coupling body 106.

The coupling shaft 102 has a first end 110 and a second end 112. A flange 114 is positioned between the first and second ends 110, 112. The flange provides an abutment surface 116 that remains in contact with the biasing element 104 during normal operation of the ice pusher 12.

The first end 110 contacts the cam surface 86 (see FIG. 3). The second end 112 of the coupling shaft 102 is received in a coupling shaft aperture 126 formed in a first end 122 of the coupling body 106. As will be explained in greater detail below, the second end 112 of the coupling shaft 102 is inserted into the coupling shaft aperture 126 of the coupling body 106 such that the coupling shaft 102 may slide within the coupling shaft aperture 126 until the abutment surface 116 comes into contact with the first end 122 of the coupling body 106. However, when assembled, the coupling shaft 102 is positioned relative to the coupling body 106 such that it cannot slide entirely out of the coupling shaft aperture 126 of the coupling body 106 during operation.

The coupling body 106 also has a flange 130 positioned between the first end 122 and a second end 124 of the coupling body 106. The flange 130 of the coupling body 106 provides first and second opposed abutment surfaces 132, 134. As can be seen in FIG. 4, the coupling shaft 102, biasing element 104, and coupling body 106 are aligned such that the first abutment surface 132 remains in contact with the biasing element 104. As such, the biasing element is generally constrained between the abutment surface 116 of the coupling shaft 102 and the first abutment surface 132 of the coupling body 106. As will be explained in greater detail below, the second abutment surface 134 of the coupling body 106 will contact the bottom wall 66 of the housing 28 (see FIG. 2) when the ice pusher 12 is in the extended position. The second end 124 also has a pushrod aperture 128 formed therein, for receipt of a first end 152 of a pushrod 142 of the pushrod assembly 16.

Sill referring to FIG. 4, the push rod assembly 16 includes a push rod 142, a biasing element 144 fixedly connected to a groove 160 of the push rod 142, and a biasing element housing 146 receiving a portion of the biasing element 144 of the push rod assembly 16. The push rod 142 extends between first and second ends 152, 154. The first end 152 is received in the push rod aperture 128 of the coupling body 106. The second end 154 is adapted to contact the sheet of ice 22 as described below. The push rod 142 also includes a flange 148 positioned between the first and second ends 152, 154. The flange provides first and second abutment surfaces 156, 158 as illustrated. As will be described in greater detail below, the first and second abutment surfaces 156, 158 are arranged to limit the travel of the push rod 142.

The biasing element 144 and biasing element housing 146 are axially arranged along the length of the push rod 142. More specifically, the biasing element housing 146 is generally cup shaped and extends between first and second ends 170, 172. The biasing element housing 146 includes an opening at the first end 170 providing access to a cavity 176 (see FIG. 5). A push rod aperture 178 is formed at the second end 172 of the biasing element housing 146, and allows the push rod 142 to pass through the second end of the biasing element housing 146 so that the push rod 142 can extend into the cavity 176 and out of the opening of the first end 170 of the biasing element housing 146.

The biasing element 144 is constrained within the biasing element housing 146 and to the push rod 142 at the groove 160 thereof such that the biasing element 144 shortens as the push rod 142 is extended out of the push rod aperture 178 of the biasing element housing 146. The biasing element 144 can be mounted within the groove 160 in a variety of ways, including using retainer clips, washers, welding, brazing, etc. Such an arrangement causes the push rod 142 to move relative to the biasing element housing 146 under the force provided by the biasing element 144 to return the push rod 142 to a predetermined position as described below.

Having introduced and generally described the structural components of the ice pusher 12, the following describes the operation of the ice pusher 12.

Figure 5:
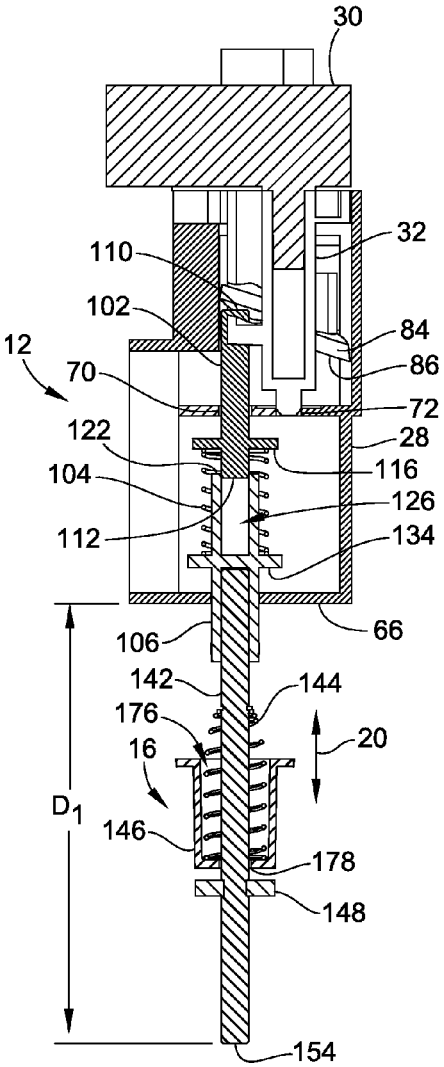
FIG. 5 is a side cross section of the ice pusher and pushrod assembly in a retracted position.

Turning now to FIG. 5, the ice pusher 12 is illustrated in the retracted position. In the refracted position, the first end 110 of the coupling shaft 102 is in contact with the cam surface 86 of the cam 32 as illustrated. The abutment surface 116 of the coupling shaft 102 is not in contact with the first end 122 of the coupling body 106. Similarly, the second abutment surface 134 of the coupling body 106 is not in contact with the bottom wall 166 of the housing 28. Such a configuration causes the second end 154 of the push rod 142 to be situated at a distance D1 from the bottom wall 66 of the housing 28.

Figure 6:
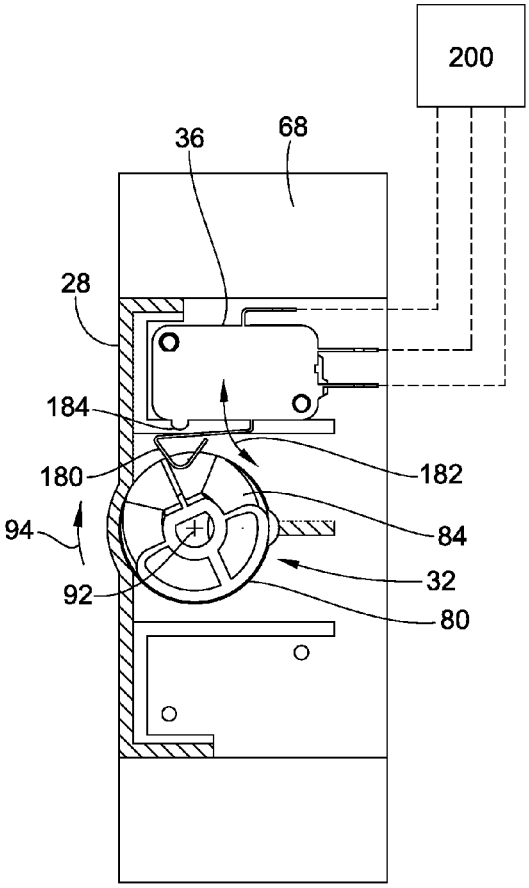
FIG. 6 is a top cross section of the ice pusher in the retracted position of FIG. 5.

Turning now to FIG. 6, a top cross section of the ice pusher 12 is illustrated in the retracted position. In the retracted position, the cam 32 has rotated about axis 92 in direction 94 such that the cylindrical outer periphery 80 of the cam 32 does not contact a rocker arm 180 of the sensor 36. As illustrated, the rocker arm 180 is also out of contact with a button 184 of the sensor 36.

As a result, the sensor 36 is in an open position, and a control arrangement 200 operably coupled to the sensor 36 detects this condition. The control arrangement 200 may be supplied as a stand-alone unit with the ice pusher 12, or may be an existing control arrangement of an ice-making module incorporating the ice pusher 12. Further, the motor 30 (see FIG. 5) may be electrically coupled to the control arrangement 200, such that the control arrangement 200 directly governs the operation of the motor 30 and cam 32 coupled thereto. Alternatively, the control arrangement 200 can communicate with a stand-alone power supply and/or controller arranged to govern the operation of the motor 30.

Additionally, rotation of the cam 32 about axis 92 causes the first end 110 of the coupling shaft 102 to slide along the cam surface 86 to position the push rod 142 at distance D1 as described above relative to FIG. 5. Put another way, the first end 110 of the coupling shaft 102 remains in slidable contact with the cam surface 86 while the cam 32 rotates in direction 94, with this rotation terminating upon achieving the distance D as shown in FIG. 5.

Figure 7:
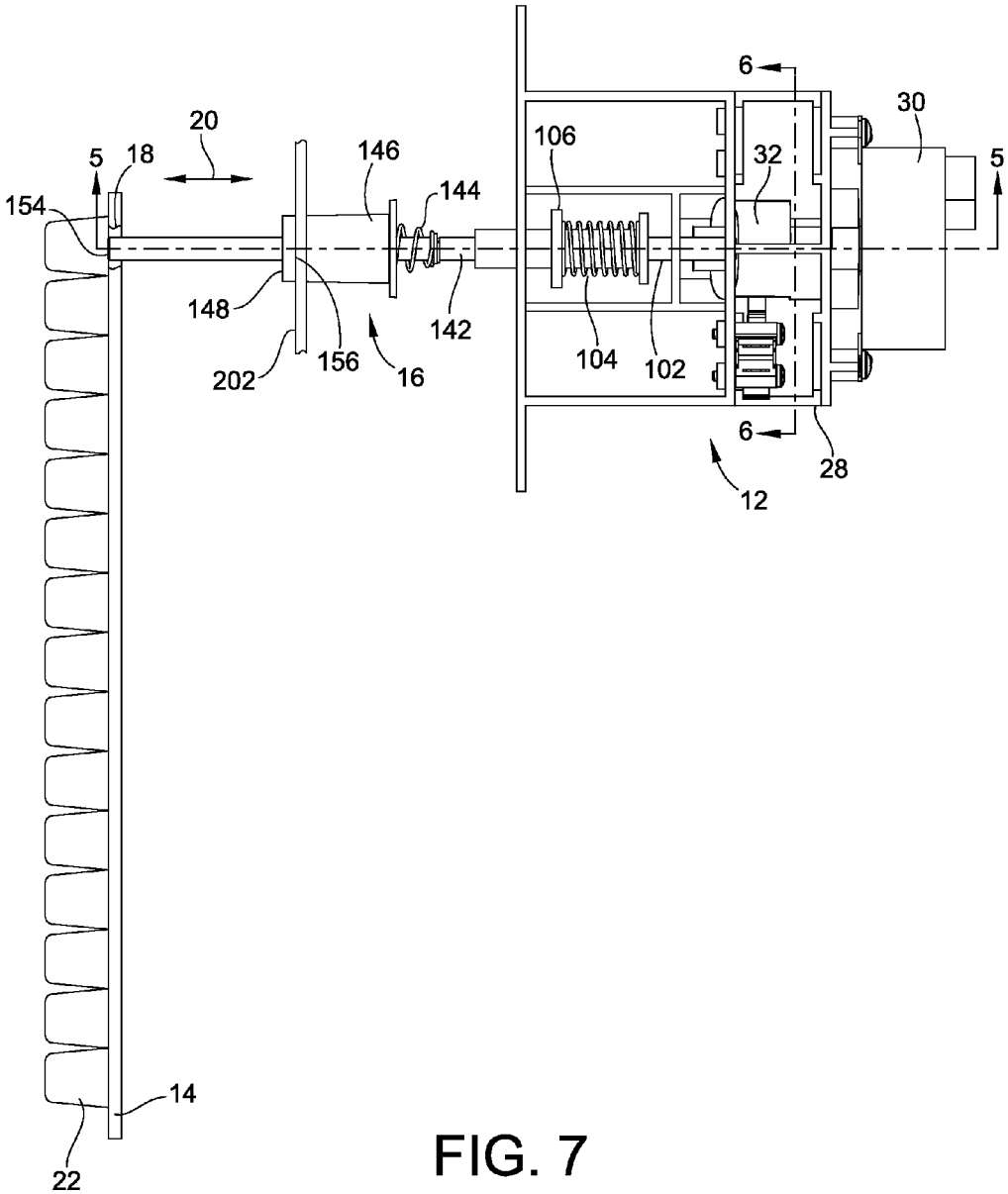
FIG. 7 is a side view of the ice pusher and pushrod assembly installed in an exemplary ice-making module environment, with the ice pusher and pushrod assembly in the retracted position.

Turning now to FIG. 7, the ice pusher 12 is illustrated again in the retracted state, and situated in relationship to the evaporator plate 14. Second end 154 of the push rod 142 is positioned within the aperture 18 of the evaporator plate 14. However, the second end 154 of the push rod does not extend through the evaporator plate 14 to such an extent as to bias the sheet of ice 22 off of the evaporator plate 14. Further, the first abutment surface 156 of the push rod flange 148 is in abutted contact with a wall 202 of the ice making module. This abutted contact prevents further movement of the push rod 142 away from the evaporator plate and thereby generally limits the travel of the push rod 142. During a typical ice making cycle, the ice pusher 12 remains in the retracted position as illustrated in FIGS. 5-7 until the sheet of ice 22 is to be removed from the evaporator plate 14.

Figure 8:
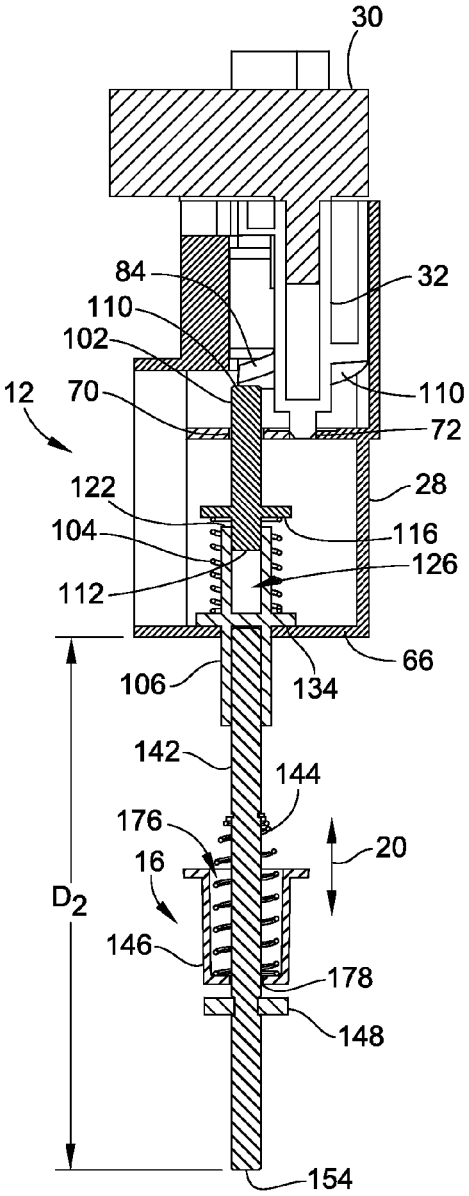
FIG. 8 is a side cross section of the ice pusher in an extended position.

Turning now to FIG. 8, the ice pusher 12 is now illustrated in the extended position. In this position, the first end 112 of the coupling shaft 102 is in contact with the cam surface 86 of the cam 32 as illustrated. The abutment surface 116 of the coupling shaft 102 remains out of contact with the first end 122 of the coupling body 106, with the second end 112 of the coupling shaft 102 partially received in the coupling shaft aperture 126 of the coupling body 106. The second abutment surface 134 is in contact with the bottom wall 66 of the housing 28. As a result, the second end 154 of the push rod 142 is at a distance D2 from the bottom wall 66 of the housing 28. The distance D2 is greater than the distance D1 illustrated in FIG. 5.

Figure 9:
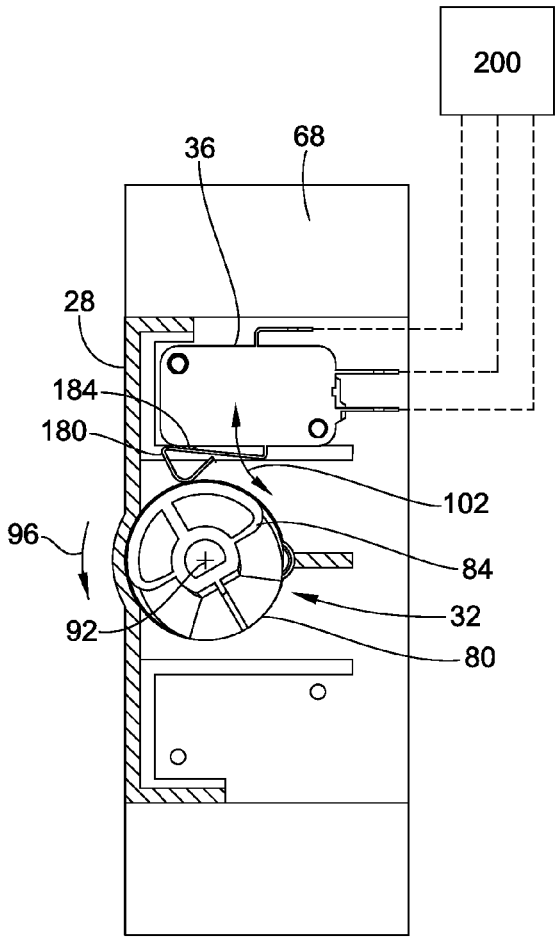
FIG. 9 is a top cross section of the ice pusher in the extended position of FIG. 8.

Turning now to FIG. 9, a top cross section of the ice pusher 12 is illustrated in the extended position. In this position, the cam 32 has rotated about axis 92 in direction 96 such that the cylindrical outer periphery 80 of the cam 32 contacts the rocker arm 180 of the sensor 36 to bias the rocker arm 180 along direction 182 and into contact with the button 184 of the sensor 36. As such, a signal is then delivered to the control arrangement that such contact has been made. Additionally, rotation of the cam 32 about axis 92 in direction 96 causes the first end 110 of the coupling shaft 102 to slide along the cam surface 86 to position the push rod 142 at distance D2 as described above relative to FIG. 8. Put another way, the first end 110 of the coupling shaft 102 remains in slidable contact with the cam surface 86 while the cam 32 rotates in direction 96, with this rotation terminating upon achieving the distance D2 as shown in FIG. 8.

Figure 10:
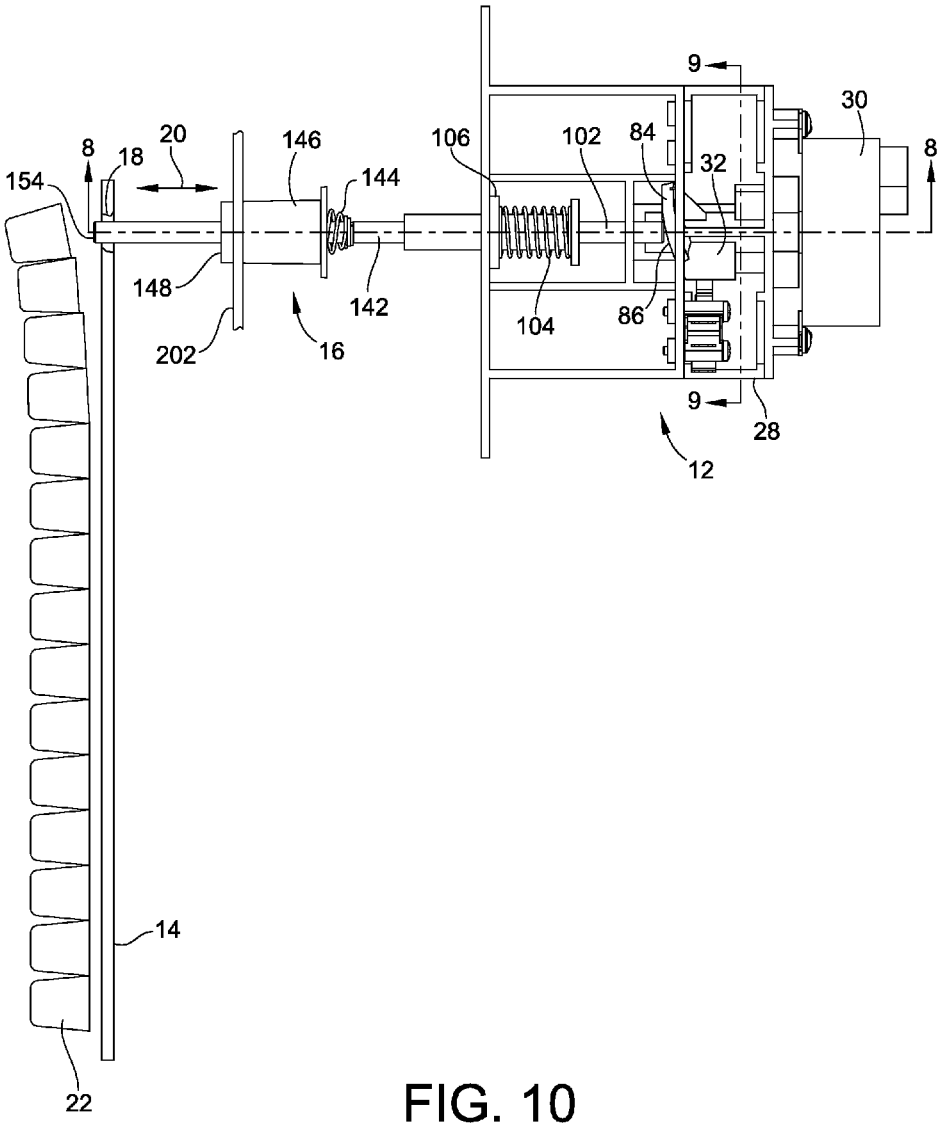
FIG. 10 is a side view of the ice pusher and pushrod assembly installed in the environment of FIG. 7, with the ice pusher and pushrod assembly in the extended position, to effectuate the removal of a sheet of ice from an evaporator plate.

Turning now to FIG. 10 the ice pusher 12 is again illustrated in the extended position. In this position, the second end 154 of the push rod 142 extends through the evaporator plate 14, and more particularly the aperture 18 formed therein to break the sheet of ice 22 free from the evaporator plate 14. Once free, the cam 32 rotates back to the retracted position as illustrated in FIGS. 5-7. As the cam 32 makes this rotation, the biasing element 144 of the push rod assembly 16 biases the push rod 142, as well as the entire coupling assembly 34, along a direction parallel to axis 20 such that the coupling shaft 102 is in continued contact with the cam surface 86. Such operation ensures that the push rod assembly 16, and coupling assembly 34 returned to their respective positions when the ice pusher 12 is in the retracted position.

Figure 11:
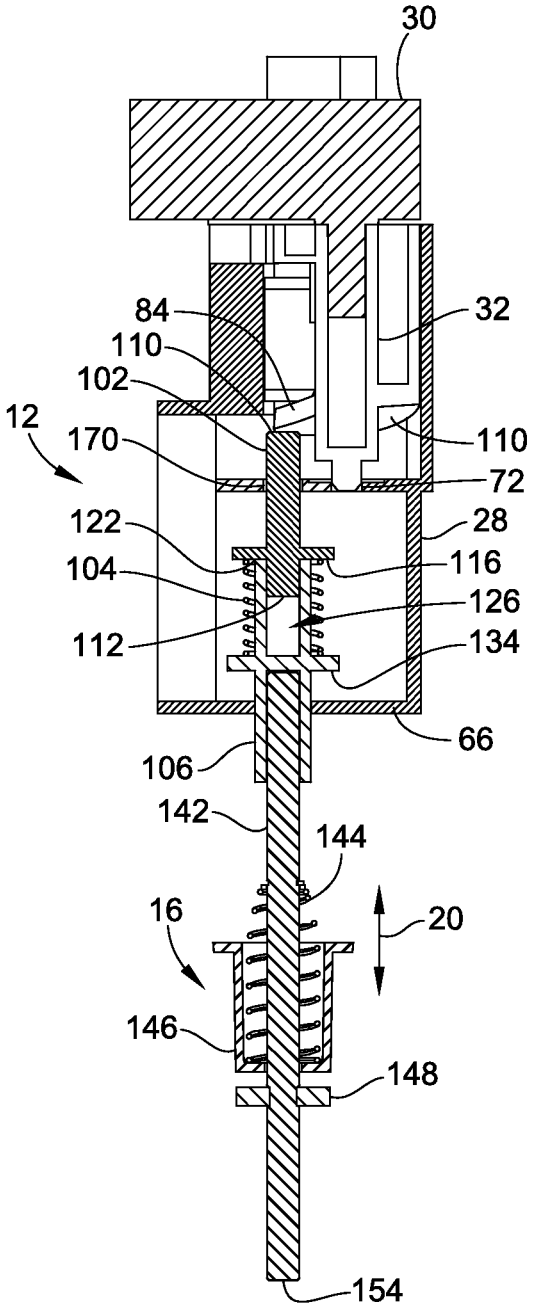
FIG. 11 is a side cross section taken through the same plane as the cross section shown in FIG. 5 of the ice pusher and pushrod assembly in the retracted position, with a coupling shaft and a coupling body of the coupling assembly of FIG. 3 in a fail-safe position.

Turning now to FIG. 11, the coupling assembly 34 is also configured to allow the cam 32 to rotate from the retracted position to the extended position illustrated above in FIGS. 5 and 8 respectively when linear movement along an axis parallel to axis 20 of the push rod assembly 16 is prevented. Such a scenario can arise when the evaporator plate 14 (see FIGS. 9, 10) has become overloaded with ice and the force provided by the push rod assembly 16 is insufficient to break free. When this occurs, the abutment surface 116 of the coupling shaft 102 will move along an axis parallel to axis 20 and into contact with the first end 122 of the coupling body 106. In doing so, the biasing element 104 of the coupling assembly 34 will be compressed between the flange 114 of the coupling shaft 102 and the flange 130 of the coupling body 106.

The amount of linear travel of the coupling shaft 102 relative to the coupling body 106 is equal to or greater than the total movement of the push rod assembly 16 and coupling assembly 34 when moving from the retracted position to the extended position under normal operation. As a result, and as illustrated in FIG. 11, the coupling body 106 and the push rod assembly 16 will remain in their respectively retracted positions relative to the housing 28. Nonetheless, the cam 32 can freely rotate to its position when in the extended position so as to avoid overloading the motor 30 of the ice pusher 12. When the cam 32 rotates back to the retracted position, the biasing element 104 of the coupling assembly 34 will bias the coupling shaft 102 relative to the coupling body 106 back to the retracted position. It will be recognized that such a construction provides a fail-safe measure in the event the ordinary linear movement of the push rod assembly 16 is otherwise prevented.

A typical cycle of operation of the ice pusher 12 is as follows. The ice pusher 12 is at the retracted position as illustrated at FIGS. 5-7 as a sheet of ice forms on the evaporator plate 14 (see FIG. 1). Once a sufficient amount of ice has formed, the ice pusher 12 then moves to the extended position as illustrated at FIGS. 8-10. More specifically, power is supplied to motor 30 (see FIG. 1) to rotate the cam 32 about axis 92 along direction 96 as illustrated in FIG. 9.

Power may be supplied by the motor 30 in response to a signal from the control arrangement 200 (see FIGS. 6 and 9), or in response to a signal delivered from a controller of the ice-making module incorporating the ice pusher 12, once the particular controller utilized has determined that an ice formation cycle is complete. Such a determination may be time-based (e.g. by watching an off and/or on time of the water supply or motor 30), based on observing a temperature of the evaporator plate, and/or based on any other parameter indicative of the formation of a sheet of ice 22 of sufficient size.

Cam 32 rotates about axis 92 in direction 96 until the rocker arm 180 depresses the button 184 of the sensor 36, also as shown in FIG. 9. This rotation causes the coupling assembly 34 as well as the pushrod assembly 16 to extend from the housing 28 such that the second end 154 of the pushrod 142 contacts the sheet of ice 22 and biases it away from the evaporator plate as illustrated in FIG. 10.

Further, and as introduced above relative to FIG. 11, in the event the pushrod assembly 16 is prevented from linear movement to the extended position, the cam 32 will nonetheless rotate in direction 96 as described above. As illustrated at FIG. 11, the coupling shaft 102 will move linearly relative to the coupling body 106, until an abutted contact between the coupling shaft 102 and coupling body is achieved. This abutted contact will not be achieved until the cam 32 has made its full rotation in direction 96 as described above. As such, the rotation of the cam 32, and the motor 30, will not be impeded in the event of a pushrod assembly 16 blockage.

Once at full extension, power is supplied to motor 30 (see FIG. 1) to rotate the cam about axis 92 along direction 94 to return the ice pusher 12 to the retracted position as shown at FIG. 5. Power may be supplied by the motor 30 in response to a signal from the control arrangement 200 (see FIGS. 6 and 9), or in response to a signal delivered from a controller of the ice-making module incorporating the ice pusher 12. As was the case above, the signal to return the ice pusher 12 to the retracted position may be time-based, based on observing a temperature of the evaporator plate, and/or based on any other parameter indicative of the removal of the sheet of ice 22 from the evaporator plate.

Cam 32 rotates about axis 92 in direction 94 until the rocker arm 180 is no longer in contact with the button 184 of the sensor 36, as shown in FIG. 6. This rotation causes the coupling assembly 34 as well as the pushrod assembly 16 to retract into the housing 28 such that the second end 154 of the pushrod 142 is positioned within the aperture 18 of the evaporator plate at a location sufficient to allow the formation of a sheet of ice 22 thereon in a following cycle, as illustrated at FIG. 7. The ice pusher 12 is then ready to repeat the ice removing cycle as described above.

As described herein, the ice pusher 12 incorporates a novel cam 32 and linear actuation arrangement for removing ice from an evaporator plate 14. The incorporation of the cam 32 and linear actuation arrangement overcomes the size, weight, and inefficiency problems of prior designs by presenting a smaller, lighter, more energy efficient package.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An ice pusher for removing ice from an evaporator plate of an ice-making machine, comprising:

a housing;

a motor mounted to the housing, the motor having a rotatable drive shaft;

a cam carried by the housing, the cam coupled to the motor and rotatable relative to the housing with the drive shaft;

a linear actuation arrangement in contact with a cam surface of the cam such that the linear actuation arrangement moves linearly relative to the housing upon rotation of the cam;

wherein the linear actuation arrangement comprises a coupling shaft slidably connected to a coupling body, the linear actuation arrangement further comprising a biasing element interposed between the coupling shaft and the coupling body such that the biasing element biases the coupling shaft axially away from the coupling body;

wherein the coupling shaft, biasing element, and coupling body are movable to a retracted position relative to the housing upon rotation of the cam in a first direction, and wherein the coupling shaft, biasing element, and coupling body are movable to an extended position relative to the housing upon rotation of the cam in a second direction opposite the first direction;

wherein the coupling body extends from a bottom wall of the housing a first distance in the retracted position, and a second distance in the extended position, wherein the second distance is greater than the first distance; and wherein the coupling shaft and biasing element are movable relative to the housing and relative to the coupling body to a fail-safe position upon rotation of the cam in the second direction, such that an abutment surface of the flange of the coupling shaft is in abutted contact with a first end of the coupling body.

2. The ice pusher of claim 1, wherein the coupling shaft extends between a first end and a second end, wherein the first end abuts the cam surface of the cam, and the second end is received in a coupling shaft aperture of the coupling body.

3. The ice pusher of claim 2, wherein the coupling shaft includes a coupling shaft flange positioned between the first and second ends of the coupling shaft, the coupling shaft flange providing an abutment surface, the biasing element of the linear actuation arrangement in abutted contact with the abutment surface of the coupling shaft flange.

4. The ice pusher of claim 3, wherein the coupling body extends between a first end and a second end, wherein the coupling shaft aperture is formed in the first end of the coupling body, and wherein a pushrod aperture is formed in the second end of the coupling body and operable to receive a pushrod assembly such that linear movement of the coupling body results in linear movement of the pushrod assembly.

5. The ice pusher of claim 4, wherein the coupling body includes a coupling body flange positioned between the first and second ends of the coupling body, the coupling body flange providing first and second abutment surfaces in opposed spaced relation, wherein the first abutment surface is in abutted contact with the biasing element of the linear actuation arrangement, and wherein the second abutment surface is in abutted contact with a bottom wall of the housing when the ice pusher is in an extended position.

6. The ice pusher of claim 1, wherein the coupling body extends the first distance from the housing in the fail-safe position.

7. The ice pusher of claim 1, wherein the cam has a cylindrical inner core and a helix shaped ramp structure extending from the inner core, wherein the helix shaped ramp structure provides the cam surface.

8. The ice pusher of claim 1, further comprising a sensor operably mounted to the housing to detect rotation of the cam.

* * * * *